United States Patent [19]

Jones et al.

[11] 4,398,720

[45] Aug. 16, 1983

[54] ROBOT COMPUTER CHESS GAME

[75] Inventors: Lawrence T. Jones, Playa del Rey; Ashley Howden; Mark S. Knighton, both of Los Angeles; Anson Sims, Granada Hills; David L. Kittinger, Van Nuys; Richard E. Hollander, Santa Monica, all of Calif.

[73] Assignee: California R & D Center, Culver City, Calif.

[21] Appl. No.: 222,436

[22] Filed: Jan. 5, 1981

[51] Int. Cl.[3] ..... A63F 3/02

[52] U.S. Cl. ..... 273/238; 364/410; 364/513

[58] Field of Search ..... 273/237, 238; 200/61.1, 200/61.11, 83 L; 335/205, 206, 207; 340/323 R, 365 L; 364/410, 513; 318/280, 290, 747; 414/1, 2, 4; 3/1.1; 434/128

[56] References Cited

U.S. PATENT DOCUMENTS

| | | | |
|---|---|---|---|
| 3,654,392 | 4/1972 | Beinhocker et al. | 273/238 |
| 3,739,117 | 6/1973 | Melton | 273/238 |
| 3,759,563 | 9/1973 | Kitamura | 414/4 |
| 3,843,132 | 10/1974 | Ferguson | 273/238 |
| 3,849,668 | 11/1974 | Dane | 414/4 |
| 4,067,070 | 1/1978 | Seamone et al. | 3/1.1 |
| 4,068,763 | 1/1978 | Fletcher et al. | 3/1.1 |
| 4,073,067 | 2/1978 | Beach | 273/237 |
| 4,130,873 | 12/1978 | Fioretta et al. | 364/513 |
| 4,235,442 | 11/1980 | Nelson | 273/237 |

FOREIGN PATENT DOCUMENTS 2051589 1/1981 United Kingdom .

OTHER PUBLICATIONS

*Robotics Age;* "The Grivet Chess Playing Arm"; vol. 1, No. 1; 1979; p. 36.

*New Yorker;* vol. LV, No. 37; Oct. 29, 1979; p. 1.

*IBM Technical Disclosure Bulletin;* vol. 6, No. 9; Feb. 1964; p. 7.

*Electronics;* Mar. 4, 1976; p. 44.

EP0016668, Application of Jean Figour, published Oct. 1980.

*Primary Examiner*—Vance Y. Hum

*Attorney, Agent, or Firm*—Jackson, Jones & Price

[57] ABSTRACT

The computer robot arm chess game assembly is provided with a chess board, magnetized chess pieces, auxiliary parking locations for the chess pieces, and an articulated radially moving robot arm. The robot arm can perform all the functions of an opponent including setting up the chess board, captures, promotions, castling, etc. The chess board and parking locations include magnetic members to not only activate resilient switches but further to spatially position the chess pieces for accurate location to assist the robot arm. Among the other interesting features, the robot arm can show emotional characteristics which can be accompanied by appropriate sounds and lights contemporaneous with a significant occurrence during the progress of the chess game.

21 Claims, 17 Drawing Figures

ROBOT COMPUTER CHESS GAME

BACKGROUND OF THE INVENTION

1. Field of the Invention

The present invention is directed to a computer chess game, and more particularly, to a robot computer chess game capable of simulating humanoid characteristics while playing an expert level of chess.

2. Description of the Prior Art

The desire to automate the playing of chess games, particularly with a humanoid configuration, has existed for a considerable period of time. Purportedly in the year 1769, a Hungarian, Baron Von Kempelen, built an alleged automatic chess player which was subsequently exhibited throughout Europe and the United States until it was destroyed in a fire in Philadelphia in 1854. The automated player was a lifesize figure that was seated on top of a box before a chess board. A pincer-like arrangement in the figure's hand could grasp and release the chess pieces to make moves. In actuality, a hidden operator purportedly manipulated the pieces. It has been alleged that the hidden player was positioned beneath the chess board and that each one of the 64 chess squares had a suspended tiny metallic ball held by silk thread hanging down beneath the board. Each of the chessmen with which the automaton played above had a magnet inside. The movement of any one of the chessmen onto a square attracted the little ball until it attached to its corresponding square below. The hidden operator would then accordingly adjust chess pieces on a small chess board to keep track of the individual moves and to monitor the movement of the pincer arm.

More recently, there has been proposed a chess playing cartesian coordinate robotistic arm and hand with stepping motors that has been commercially advertised as the Boris Handroid. An article in ROBOTICS AGE, Vol. 1, No. 1, Summer 1979, pages 36–44, "The Grivet Chess Playing Arm" further describes a robot manipulator with the D.C. motors controlled by optical sensors that provide a workspace sufficient to extend across a chess board.

With the advent of the computer, and more recently, the availability of economical microprocessor circuits and memories, automatic chess games with various visual and graphic displays have been made commercially available. Generally, these chess computer games have been provided with a playing board, a limited display, and a keyboard. Frequently, the playing board incorporates female receptacles for receiving individual chess pieces and for verifying the position of a particular chess piece with the microprocessor's circuitry. LEDs (Light Emitting Diodes) are generally positioned in each square of the chess board to provide visual coordinate positions for indicating the computer's move and also, to indicate the responding move by the human. The electronic displays generally provide an alphabetic and numerical readout indicating a particular piece and coordinate as is well known in the field of chess. Alternative playing boards have also been suggested that use an opaque resilient chess board, having a relatively planar surface with appropriate indicia to indicate a board configuration. The chess pieces are positioned on the board in a conventional manner and again, LEDs are provided in each square. By pressing the surface of the resilient chess board, the player closes a switch and activates a light on the square. The player moves the chess pieces, not only for his move, but to comply with the activated lights that disclose the counter moves by the chess computer.

Various accessory chess component parts have also been recently suggested, such as a synthesizing voice that is capable of informing you of each move, capture, and also capable of repeating the position of a chess piece on demand, an electronic printer for keeping record of the game, and a chess clock.

After all these years, the prior art is still seeking to provide a humanistic automaton chess playing component that is capable of creating a physiological and psychological impact of playing a machine with human characteristics that nevertheless has been honed to the perfection and repeatability only possible through the use of robotics.

SUMMARY OF THE INVENTION

The present invention is directed toward a computer chess game that incorporates robotic hand movement with humanoid characteristics. The chess game includes a chess board, chess pieces, a computer processing circuit, memory unit, keyboard and an articulated robot arm that is radially movable adjacent the chess board. The end of the robot arm supports a plurality of mechanical fingers that can grasp and release a chess piece.

The chess board incorporates a plurality of resilient switch members, one positioned beneath each chess square and capable of indicating the presence of a chess piece. This is accomplished by providing each chess piece with a magnet adjacent its respective base and further providing cavities beneath the chess board surface for supporting complimentary magnets. An array of switches equal to the number of chess squares are positioned immediately below the chess board surface. When a chess piece is positioned on a chess square, the magnetic force lifts the lower magnet to press and electrically close its corresponding switch member. The relative sizes of the magnets and their positions are further designed to spatially position the chess piece at a predetermined location to insure appropriate alignment for coaction with the grasping fingers of the robot arm.

Adjacent the chess board is a designated indexed storage position that is capable of receiving each of the chess pieces. The storage position can optionally include a switch member and at least include a magnet member for insuring proper spatial alignment. Optical detectors monitor drive motors determining the position of the robot arm.

A keyboard, LED indicators and a sound generator are further provided for not only implementing different game functions and play options but for further highlighting an emotional response to predetermined events in the playing of the chess game. For example, the heuristic chess program provides a computer initiated move by the robot arm and usually plots the shortest path of movement for the robot arm from its current position to a desired end position and further initiates the picking up and releasing of a chess piece. If, however, an emotion key has been activated on the keyboard the computer processing unit (CPU) is capable of activating a subroutine program if the existence of a predetermined event with particular significance in the playing of a chess game occurs. For example, the capture of the queen, promotion of a pawn, etc., can generate either elated sounds, lights and physical movements or emotion if by the computer or if accomplished by the human player, can initiate corresponding despair sounds, lights and movements.

The robot arm can further provide a physical indication of a suggesed move by the CPU to the human player upon activation of a Hint key. Additionally, the robot arm can point at levels of skill for selection by the player by appropriate reference to an indexed section of the chess board.

The objects and features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

DETAILED DESCRIPTION OF THE PREFERRED EMBODIMENTS

Figure 1:
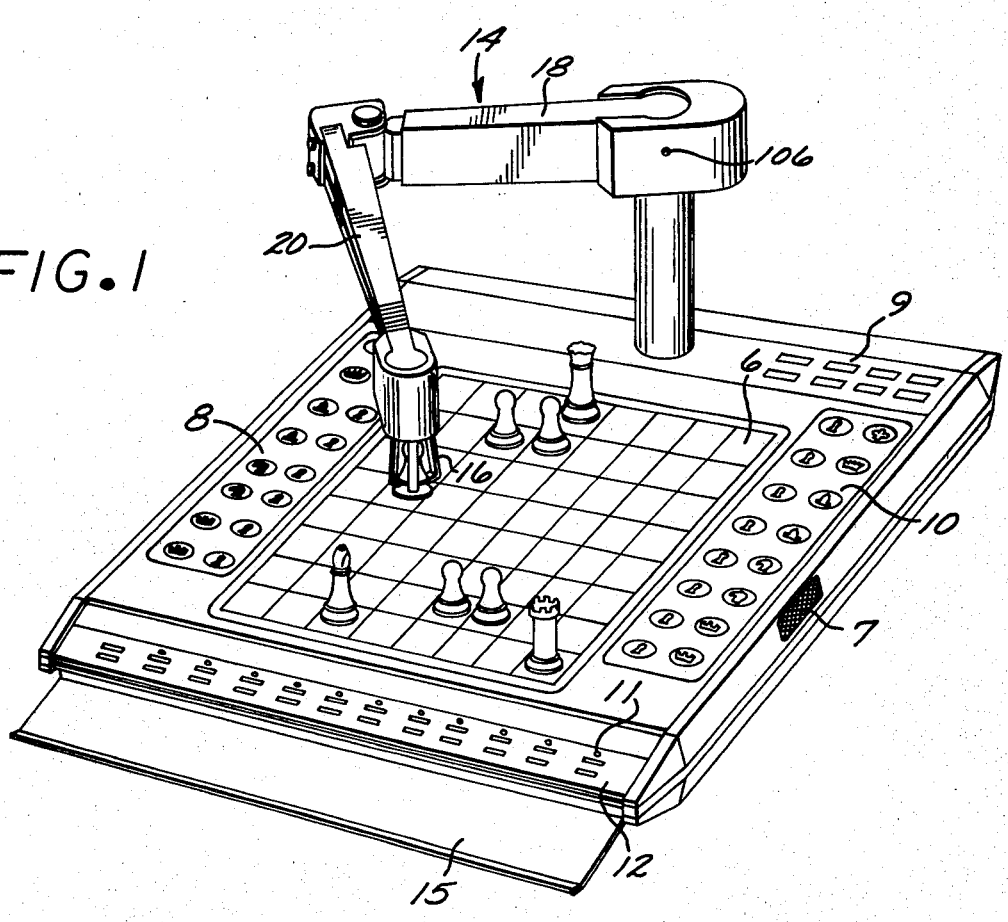
FIG. 1 is a perspective view of the robot arm and chess game.

The following description is provided to enable any person skilled in the electronic games field to make and use the present invention and sets forth the best modes contemplated by the inventors for carrying out their invention. Various modifications, however, will remain readily apparent to those skilled in the art, since the generic principles of the present invention have been defined herein specifically to provide a computer controlled robot arm chess game.

Basically, the present invention permits a human player to play a chess game in a conventional manner against an opponent that at a minimum will exhibit the same kinematic movements of a human opponent. At the option of the human player, the robot computer chess assembly can further exhibit both sound and gesture movements reminiscent of the emotion of an opponent chess player. Thus, the human can make his conventional moves and simply watch the robot arm 14 play counter moves, including the capturing and removal of the human player's pieces from the board. Thus, from the start of the chess game to a draw or a checkmate, the human player will only be required to play his normal game of chess as if he had a human opponent.

The present invention incorporates a chess playing heuristic program that is typical of a class of computer programs which currently exist. Examples of such programs are disclosed in well known documented forms such as the Sargon 1.0, which has been described in a book entitled "Sargon—A Computer Chess Playing Program", published by Hayden Book Co., Inc., of Rochelle Park, N.J., in 1978, which is hereby incorporated by reference to supplement this disclosure.

Computer programs have basically the purpose of generating chess moves which respond strategically and tactically to the moves of another party. As background information only, since the particular computer heuristic chess playing program is not essential to the purposes nor the reproduction of the present invention, the heuristic can be described as composed of the following components:

1. A chess piece moving generating section which generates the chess piece moves;

2. A position evaluation section which consists of a number of chess heuristics used to obtain a numeric score for a game chess position. The position score is indicative of the strength of a particular board position, and relates to the relative strategic strength associated with the game piece locations of each side;

3. A material evaluation section which determines the probable outcome of attacks by the various chess pieces on the chess board for any given position. The material score is indicative of the strength of the pieces on the board after a particular move, and relates to the relative tactical strength of the remaining pieces of each side;

4. A control section which manages an iterative depth first $\alpha/\beta$ search; and 5. A move analyzer section which processes each chess position created by the move generator section.

The overall analysis of the possible moves is performed by a move analyzer section which processes each chess position created by the move generator section. At each ply (corresponding to possible means by one of the players in a given turn), the move analyzer calls upon the material evaluation section to determine whether the position created by the move generator section is better than or equal to any previous position at this level. If the created chess position is not better than or equal to any previous position at this level, the move analyzer returns to the move generator for another move. When a created position is materially better than or equal to any previous position at the given level, the move analyzer will call the position evaluator. If the position evaluator determines that the current position is not better than any previous position at this level, the move generator is again called upon to come up with another move. If the current position score is better than any previous position score at this level, the current position parameters are used as the best position at this level, and control is returned to the control section. The control section continues the search for each move at each ply and for successive plies until the predetermined number of positions have been analyzed, as defined by the skill level of play.

As can be readily appreciated, various degrees of skill corresponding basically to the number of advance moves searched can be provided for playing the chess game. The present invention is directed to a means of implementing the chess computer program in a manner and mode which will emulate humanoid characteristics while maintaining a robotic form.

Referring to FIG. 1, a perspective view of the robot computer chess game assembly 2 is disclosed. A house member 4, that can be molded from plastic, provides a chess board 6 and a pair of chess piece storage areas 8 and 10 across its upper surface. A keyboard 12 is positioned adjacent the chess board and provides control of the functions of the robot computer chess assembly 2. An articulated robot arm 14 is movably mounted adjacent the chess board and carries a plurality of gripping fingers 16.

The keyboard 12 provides the following functions of its keys:

1. Go
2. Take Back
3. Hint
4. Verify On/Off
5. Sound On/Off (King)
6. Auto Play (Knight)
7. Skill Level
8. New Game (Pawn)
9. Print Moves
10. Print Board
11. Cancel Command
12. Replay
13. Change Color
14. Best Move On/Off (Bishop)
15. Emotions On/Off (Queen)
16. Demo Program
17. Setup/Verify
18. Test Exercise
19. New Board (Rook)
20. Print List
21. Form Size The above identification of the chess pieces within the brackets indicate a dual function to that key as will be subsequently described.

Figure 12:
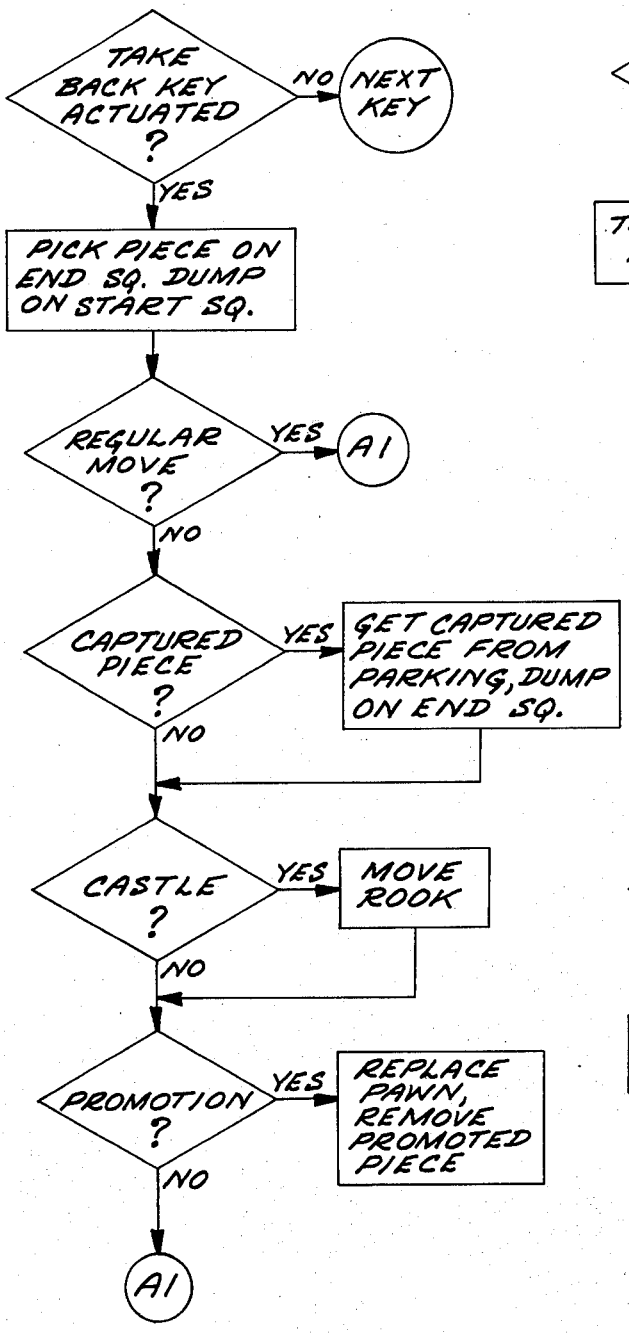

The Go key permits the player to force the computer to make a move based on the present status of its computation of the most advantageous moves. In the advanced stages of play, the integrated circuit's Central Processing Unit (CPU), for example, as exemplified by the Ziolog Z-80B, or other equivalent microprocessor, requires a number of seconds to evalutate each potential move, particularly when the chess game has progressed so that a large number of options are available to the player. Actuation of the Go button while the CPU is computing the best move will cut short the process and require the computer to make the best move then determined. Actuation of the Go button when it is the human's turn will enable the CPU to decide and perform the human player's move. Activation of the Go button at any other time will be ineffectual. The Take Back key permits the player to reinstate the current game to its immediate status before the last move, irregardless if that move was performed by the robot arm 14 or the human player. When this button is pushed, the robot arm 14 will perform the chess piece or pieces manipulation, as shown in FIG. 12.

Figure 17:
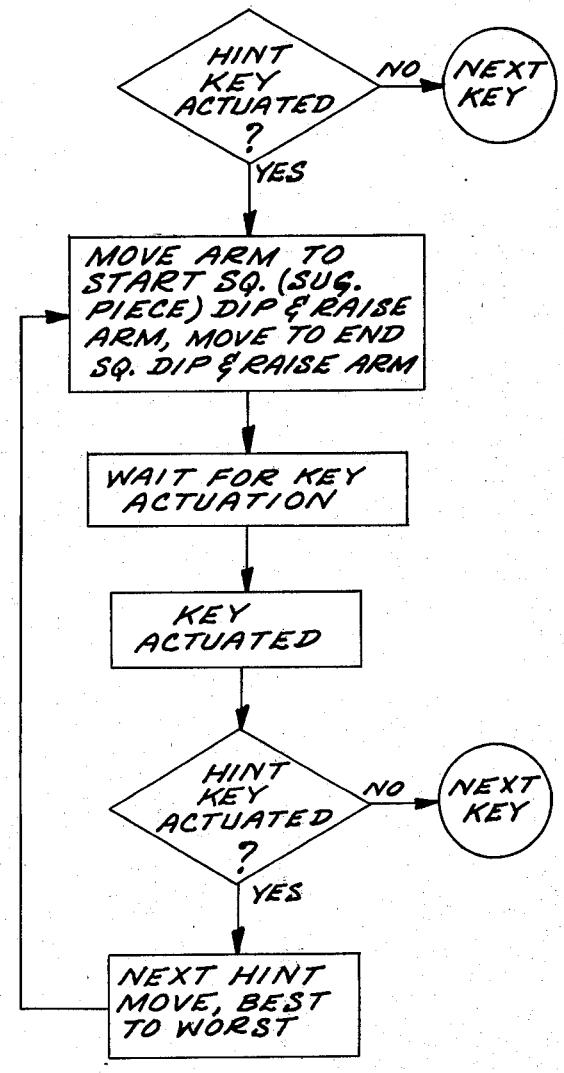

The Hint button is capable of directing the CPU to indicate to the human what the CPU thinks is the best move for the human. This indication is performed by the robot arm 14 moving over to a chess piece which is suggested to be moved, moving the lift axis of the arm down then up (not grabbing the chess piece), then moving to the desired position and again repeating the movement of the lift axis down then up. If the human player provides a second actuation of the Hint key, the CPU will indicate the next best move. The Hint key can be repeatedly actuated and the CPU will respond with an arrangement of priority moves in a best to worst order, as disclosed in FIG. 17.

The Verify On/Off button is used to verify that the computer knows the location of all the chess pieces on the board. To enter the Verify mode, the Verify On/Off key is actuated and a verified mode indicator LED is illuminated. When in this mode, any or all chess pieces on the board may be individually picked up and the CPU will respond with what it thinks is there by illuminating (in a blinking fashion) the key that has been identified with the specific chess piece (e.g., keys 5, 6, 8, 14, 15 and 19 above), and the particular color of the chess piece by illuminating either the white or black LED indicator. When the chess piece is replaced, the blinking and color LEDs are brought back to their original state and turned off, respectively. If the chess piece is identified by the CPU incorrectly, then the proper piece should be placed there. Further verification can occur by lifting other pieces, or the verification mode may be terminated by actuating again the Verify On/Off key.

The Sound On/Off key, when actuated, will toggle the state of the On/Off bit for a sound generator (to be described). The Auto Play key will cause the CPU to go into an automatic Play mode wherein the CPU will make both moves and in effect, play against itself. A subsequent actuation of the Auto Play key while in an Auto Play mode will return it to a normal non-Auto Play operation wherein the CPU will expect to play the human.

Figure 16:
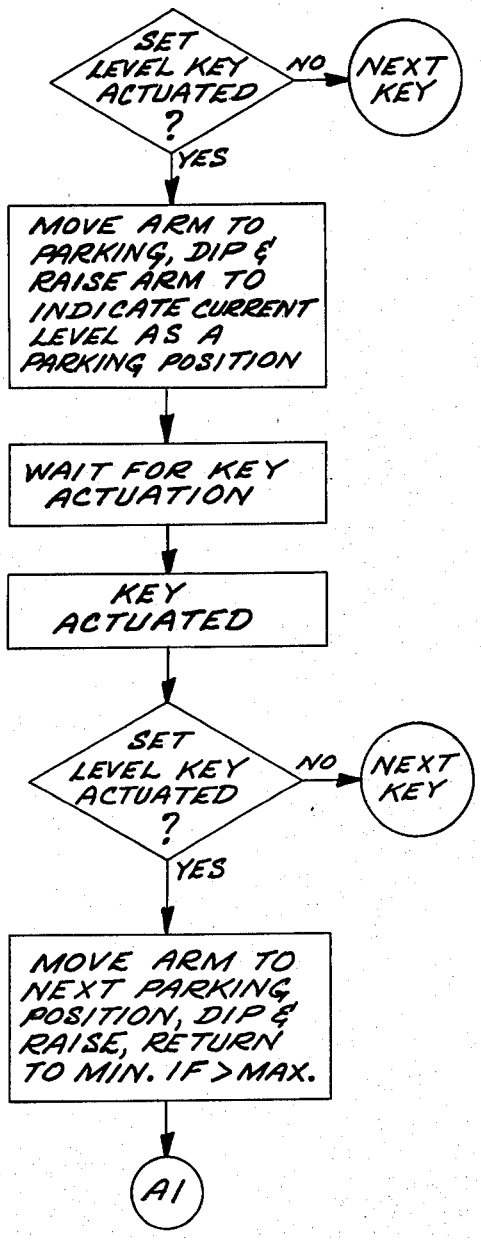

The Skill Level key will indicate the current level of skill is being processed by the CPU, and this physically occurs with the robot arm 14 moving to a physical location on the board and pointing to a point that represents a particular level. To change the current level of skill, the Skill Level key should be actuated again to increment that level until it reaches the final level, whereupon an additional actuation of the Skill Level key will reset it to the beginning level. The robot arm will, in effect, point to each level until the human operator decides to accept a certain skill level of play. (See FIG. 16.)

Figure 8:
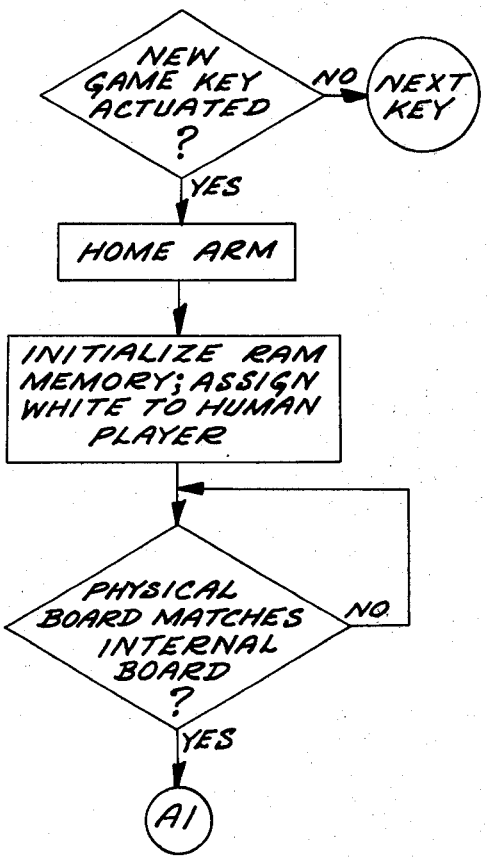
FIGS. 8 through 17 are flow charts of the functioning of various keys.

Actuation of the New Game key will initiate a new game and it will be assumed that following such a command, the chess board will be physically set up by the human player. Actuation of this key at any time forces the robot arm to return to the home position wherein first and second articulate portions of the arm 18 and 20 are folded back upon themselves to indicate a zero spatial position relative to the board as will be subsequently described (see FIG. 8).

The Print Move key and Print Board key are designed to accommodate the operation of an auxiliary printer that can be attached in a modular fashion to the house member 4. Actuation of the Print Move key will cause each move to be printed as it is performed. Actuation of the Print Board key will cause the CPU to print the current state of the board from the printer. Advantageously, a commercially available thermal printer can be used.

Figure 9:
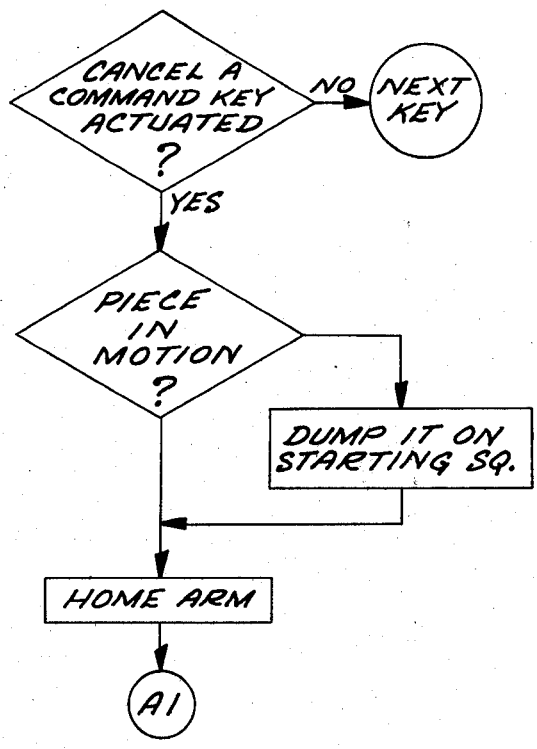

The Cancel Command key is capable of nullifying or turning off any commands that have been inputed by the Print Move, Print Board, Hint, Take Back, Replay, Auto Board Initiate, List Game, and Demo Grame. All other commands can be cancelled by simply re-actuating those specific keys again to toggle the state of the On/Off bit (see FIG. 9).

Figure 10:
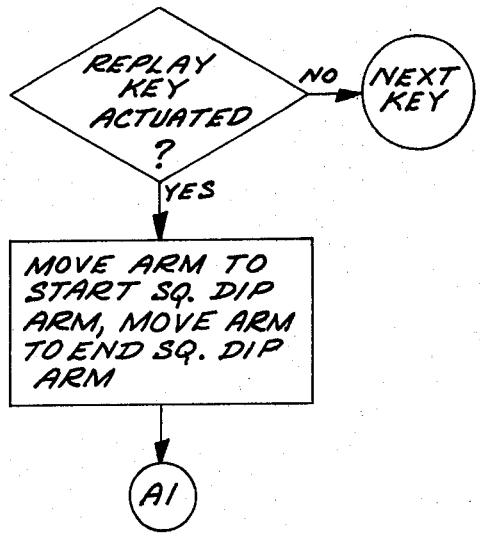
Figure 11:
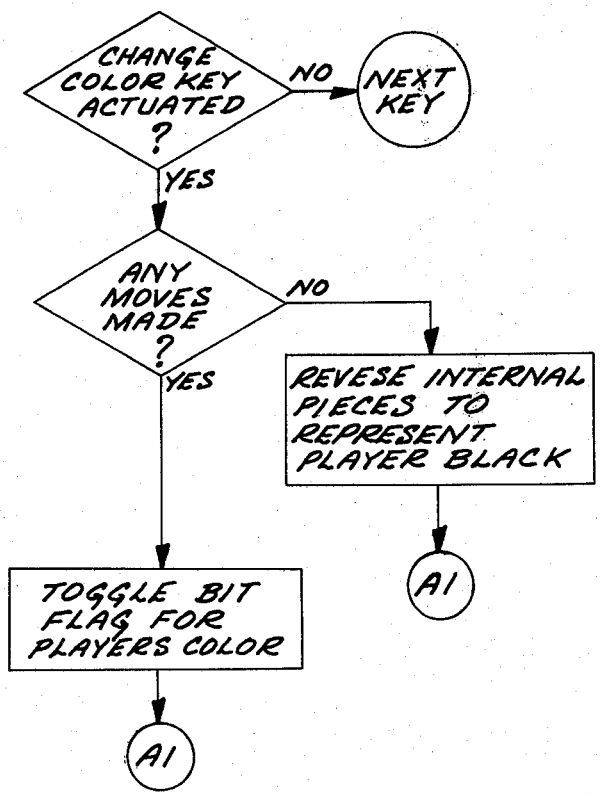

The Replay key can indicate the CPU's last move by moving the robot arm 14 to the From position, and then moving it to the To position. Thus, the human can then identify the piece and the original and changed location of it on the chess board, as disclosed in FIG. 10. The Change Color key, whose function is shown in FIG. 11, should only be actuated at the beginning of the game, and simply permits the human to select whether he wishes to play the white or black chess pieces. The Best Move On/Off key simply directs the CPU to always select the best move that he has determined from its search; otherwise, when this key has not been actuated, the CPU will sometimes randomize by selecting one of a series of the top predetermined moves available.

The Emotions On/Off key permits the CPU to, in effect, display the emotions via arm movement, sounds, and a light show via the LEDs. When not in the Emotions On state, the robot arm 14 will simply do straight fast moves only. The Demo Program key will initiate the CPU to play a predetermined game wherein the full capabilities of the robot arm 14 are displayed in a normal playing mode. Actuation of this key will initiate the robot to move to the Home position and wait for the board to be set up. Actuation of the Go key will then initiate the actual play.

Figure 14:
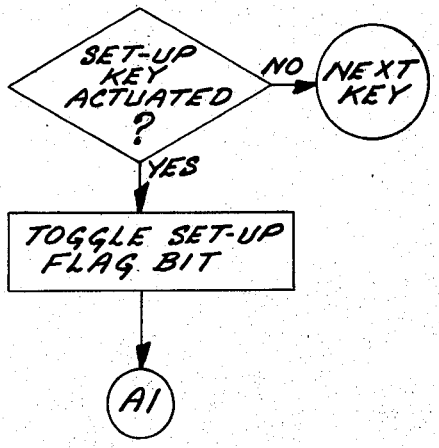

Actuation of the Setup key, FIG. 14, also actuates those keys with alternative functions and shifts their state to that of the bracketed chess piece name indication. In this regard, a specific chess piece name key is actuated, for example, the Knight, to provide an input to the CPU. The CPU will illuminate the proper display LED, giving feedback as to the name the human has selected along with the color LED indicator. The Change Color key will also be actuated if it is necessary to change the identification of the color to make the color respond to the actual color of the chess piece. The chess piece is formally accepted by the CPU as having the current last position indicated, the name is indicated, and the color is indicated, when the piece is placed on the board, and this can be followed by an auditory feedback, if desired. If it is desired to change the position of a piece on the board, the human player simply picks up the chess piece from its current location. The CPU will light the color and piece type lights for this piece. The human then places the piece in its new position, and the color and piece type lights will go off. If it is desired to move a chess piece from the board, that piece is simply picked up from its location on the board and placed in its proper storage location adjacent the chess board. The color and piece type lights will light and stay on until either the setup action is performed, or the setup mode is terminated. The exit from the setup mode is accomplished by simply activating the Cancel Command button.

The Test Exercise key will initiate a Test Exercise of the robot arm and CPU to verify operation. When this key is actuated, the robot computer chess assembly will perform at least the following functions, the robot arm 14 will pick up its chess piece in one corner and place it in another corner, the CPU will sequence the light show LEDs, play a recognizable tune on the sound generator, and test all key actuations by lighting up only one discrete LED while a single key is actuated. It is possible to terminate the Test Exercise during its performance by actuating the Cancel Command key. The New Board key instructs the CPU to set up the board automatically and assumes that the CPU knows the position of all the chess pieces in the storage areas on the sides of the chess board. The Print List key is again operable with a modular printer and actuation of this key initiates the CPU to print, in order, all the moves of the current game. The Form Size key is also an auxiliary key for use with the modular printer and simply indicates the state of how the printer will describe the moves, either in a short abbreviated form or in a long form.

A series of indicator lights, such as light emitting diodes (LEDs), provide additional information to the human player, such as monitoring the functioning of the CPU. Appropriate legends are utilized with the LEDs. The Illegal Move light indicates that some illegal action has occurred, such as a wrong color chess piece move, an improper move for that type of chess piece, or a chess piece moved at a wrong time, for example, in an Auto Play mode. The Robot Light indicates when illuminated that the robot arm 14 currently has the move. The Human Light indicates that the human currently has themove option. The Auto Play (Knight) indicates that the chess assembly is currently in the Auto Play mode. The Demo Program (Pawn) indicates that the chess assembly is currently performing the pre-planned demonstration program.

The Sound Light (King) indicates that the sound generator is enabled to produce sound. The Emotions Light (Queen) indicates that the chess assembly is enabled to display emotions while playing, such as lights, sounds, and hesitant or indecisive moves of the robot arm. The Verify Mode Light, when actuated, simply indicates that the chess assembly is in a verified mode of operation, such as has been described above. The Piece Discrepancy indicates that there is a problem in determining the identity of a chess piece on a square. The Best Move Light (Bishop) indicates that the CPU is instructed to always select the best move available. The Printer Light (Rook) indicates simply that the printer is enabled. The White/Black Light is used in the Verify and Setup modes described above to indicate the particular color of a selected chess piece and when not in these particular modes of operation, this LED indicates the color of the party who currently has the move. The bracketed identification of the various chess pieces above associated with each LED indicator simply describes an alternative mode or function of the light for indicating a particular chess piece.

When actuated into the Emotions mode of operation, the robot can respond depending upon the particular situation with humanistic emotions, for example, if the chess assembly loses the game by being placed into check, the CPU can process a robot arm flinging movement with lights 9 flashing and shrieking sounds from speaker 7. If you are checkmated, however, a celebration can occur. A large repertoire of sounds are possible, such as bombs dropping, shrieks, cries, growls, cackles, and heavy breathing can be a portion of the repertoire of auditory responses. The robot arm 14 can also move across the chess board and circle, for example, a pawn prey with a feigning attack, only to clutch a neighboring knight as the actual move contemplated. Additionally, the lights 9 and 11 can pulsate to indicate feverish "thinking" during the contemplation of a move.

Figure 2:
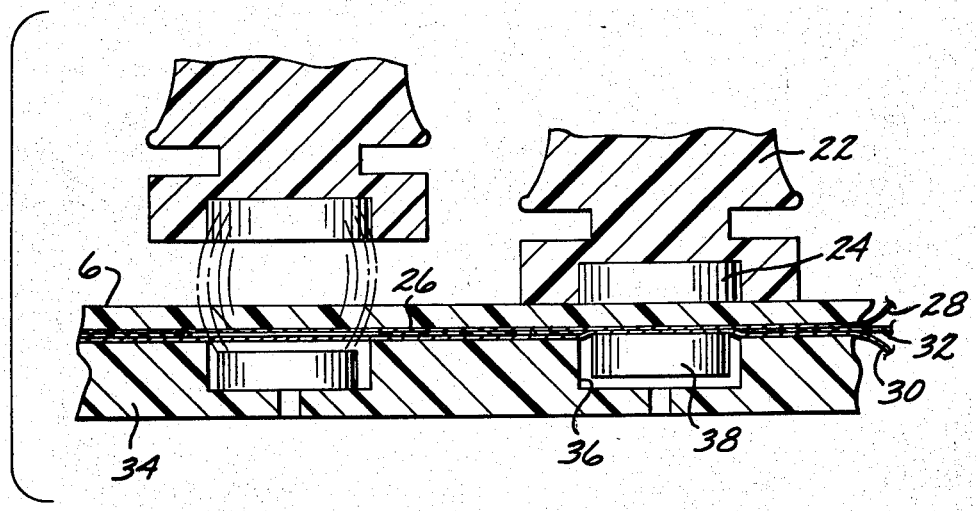
FIG. 2 is a partial side cross sectional view of the chess board and game pieces.

Referring to FIg. 2, a partial cross section of the chess board, chess piece, switch member, and magnetic means for actuating the switch member and for further spatially positioning the chesspiece at a predetermined location on the chess square is disclosed. The chess piece 22 includes a magnet member 24. Mounted beneath the chess board surface 6 is the multiple switch member 26 that comprises two layers of flexible conductive polyester sheets 28 and 30 that are separated by insulating columns or rows 32 that have been printed on the sheets. As can be appreciated, each respective sheet includes rows of conductive material that form a matrix, for example, providing a matrix of 64 switch members to correspond to each chess square of the playing board 6. An additional 32 switches can be provided for the appropriate storage area positions 8 and 10 adjacent the chess board 6. Beneath each switch member or switch cell, a support plate 34 provides a cavity 36. Movably mounted within each cavity is a complementary magnetic member 38 that is responsive to the magnetic member 24 in the chess piece 22. As can be readily appreciated, both magnetic members 24 and 38 can be magnets with appropriate polar positions to attract each other, or one of them can be of magnetizable material such as a piece of iron. The necessary requirement is that the magnetic attractive forces generated between the respective magnetic members are sufficient to drive the lower magnetic member 38 upward to compress and contact the respective conductive portions of a flexible polyester sheet 28 and 30 to provide an electrical closing of a switch member. Additionally, the magnetic member 38 is configured to be complementary with the internal surface of its cavity 36 so that it is capable of spatially positioning the chess piece at a centralized predetermined location within the chess square. This is particularly important since it will ensure a true Home position for the chess piece so that it can be grasped by the gripping fingers 16 on the robot arm 14. Correspondingly, when the gripping fingers 16 release the chess piece, any minor dislocations or movements of the chess piece from the central position on its corresponding chess square will be immediately corrected by the resulting magnetic field between the respective magnetic members. The multilayer switch member is positioned beneath each chess square and is capable of indicating the presence or absence of a chess piece. Since the multilayer switch layer is flexible, the presence of a chess piece having a magnetic member creates sufficient magnetic foce to lift the lower magnetic member in the cavity underneath the chess square so that it extends upward to close the conductor portions of the respective flexible plastic sheets that extend over all the cavities.

Figure 3:
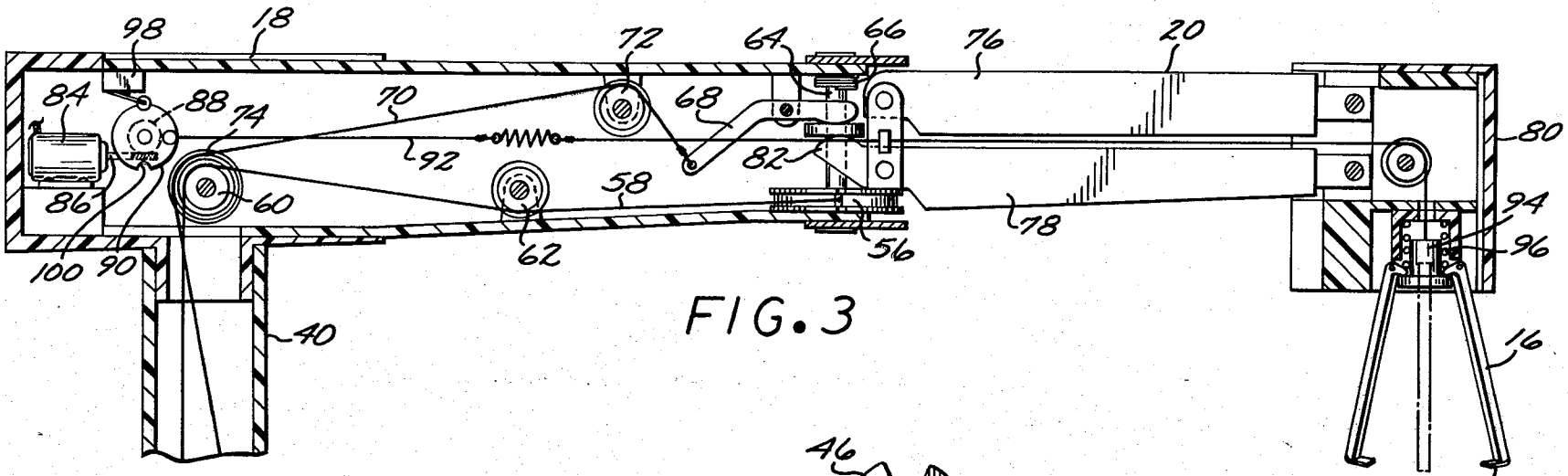
FIG. 3 is a partial side cross sectional view of the robot arm.
Figure 5:
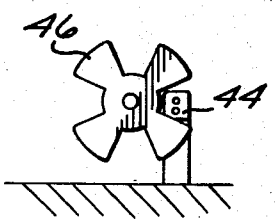
FIG. 5 is a side elevational view of an optical detector.

Referring to FIG. 3, a cross sectional side elevational view of the robot arm 14 is disclosed. As mentioned earlier, the robot arm 14 is articulated and includes a first arm portion 18 and a second arm portion 20. A mounting post 40 is rotatably mounted adjacent the board and is driven by a D.C. permanent magnetic drive motor 42, for example, of the type sold by Mabuchi Ltd. of Japan as Ser. No. RS-365S-1885. This motor is bidirectional and provides the main radial turning of the robot arm 14. An optical detector 44, for example, using a pair of infrared sources that are oculated by the rotation of the position indicator 46, shown more particularly in FIG. 5, provides an appropriate monitoring of the motor 42 to provide position signals for the CPU of both direction and rotation. The signals are indicative of one quarter of a motor shaft turn.

A pulley 48 attached to the mounting post 40 is driven by the belt 50 which in turn is connected to the drive motor 42 by gears 47, 49, and 51 and worm shaft 53.

Another pair of motor 52 and 54 of the same type as drive motor 42 are mounted within the mounting post 40 and are designed to activate the second arm portion 20. To simplify matters, one of these motors is designed to drive to a mechanical stop.

Drive motor 52 is connected to arm portion 20 through the drive pulley 56 through a chain or line member 58 that is held in position by idler pulleys 60 and 62, respectively. Drive pulley 56 is mounted on a rotatable shaft 64 that has been spring loaded by a torsion or clock spring 66 to bias the second arm portion 20 to a closed position adjacent the first arm portion 18. When motor 52 is actuated, it pulls against the force of the spring 66 to position the second arm portion 20 at the desired location within a sweep of an approximately 170 degree arc. An optical detector 55 monitors the position of the motor shaft of motor 52.

The motor 54 is connected to a cam lever or bell crank 68 which is pivotally mounted within the first arm portion 18. The chain or line member 70 passes over idler pulleys 72 and 74. The second arm portion 20 has a parallelpiped configuration which includes two rotatably mounted support rods 76 and 78 which are connected to the cam housing assembly 80 of the gripping fingers 16. The parallelpiped configuration assures a kinematic movement of the cam housing assembly 80 which remains perpendicular to the horizontal surface of the chess board 6. The upper support rod 76 includes an extended cam follower member 82 that is positioned for co-action with the bell crank 68. As can be readily appreciated, the bell crank 68 exerts a force against the gravitational pull of the second arm portion 20. A micro switch, not shown, can provide a final monitoring of the vertical movement.

Figure 6:
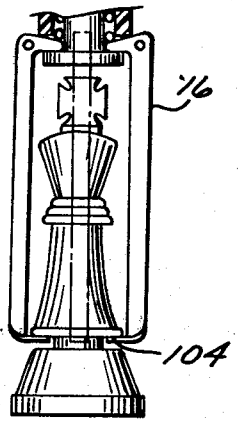
FIG. 6 is a side view of the grasping fingers.

A fourth motor 84 can be a unidirectional D.C. motor connected through a worm shaft 86 to the geat 88. Alternatively, a permanent magnet D.C. motor sold by Mabuchi Ltd. as Ser. No. RF-2601250 could be used. Mounted on the same axis as the gear 88 is a cam pulley 90 that is attached via line 92 to a camming piston 94. The piston in turn controls the upper bell crank shaped finger portions 16 by urging them shut against the force of a spring 96 that biases them to an open position. A microswitch position detector 98 is designed to interface with an On/Off cam surface 100 to indicate whether the fingers are in an open or closed state. The motor 84 is capable of driving the cam pulley 90 in one direction to open and close the spring biased fingers 16 in one cycle through a 360 degree rotation. As can be seen in FIG. 6, each of the gripping fingers 16 have a retention paw 102 that has been positioned to grasp a reduced portion of each and every chess piece. Thus, an underlying supporting shoulder 104 is provided at the same location on each chess piece, irregardless of its type.

Positional microswitches 106 on the first arm portion 18 and 108 indicate when the robot arm 14 has returned to a Home or Rest position. Referring to FIG. 1, the Home or Rest position is when the second arm portion 20 has closed the microswitch 106 and when the mounting post 40 has been rotated to close microswitch 108.

In operation, the robot arm 14 utilizes the Home position as the origin of the work space coordinate system. The application of power to the individual D.C. motors are controlled by the computer by appropriate output power bytes to regulate power switching. The velocity control for each axis of movement is performed incrementally as a result of the monitoring of the present position from the appropriate optical detectors and instructions from the computer as to the next desired position.

Generally, a motor positioning generator will set up a list of intermediate positions for each active servo channel (motor axis) that is to be implemented. These positions will be incremental points that the robot arm will theoretically move to in a straight line between a start to stop position. To maximize use of the computer searching time for the best chess moves, the robot arm will try to travel along the shortest path from a start to a stop position and thereby minimize the amount of computer time that is necessary to monitor this activity. The activation of the EMOTION key is an exception to this standard procedure. The current position is periodically updated on an equal time basis, e.g. every 16 milliseconds.

To achieve critical damping so that the robot arm 14 will slow down as it approaches its final move position and will not overrun that position, conventional feedback loops for each axis of movement are utilized. Basically, the present axis position of the robot arm 14 is sensed as an electrical signal and if it differs from the stored last position sensed, it is modulated as a function of position and time, e.g., velocity plus further modulated by appropriate velocity compensation constants. This modified signal is then added as a negative value to a positive value signal of the next incrementally desired position to provide an effective signal error position for driving the robot arm motor. Appropriate scaling constants can be used to modify the position error signal. The resultant scaled position error signal is then combined with the most recent stored old power value applied to the motor and the sum is then averaged. Limit parameters can be further used to provide boundary levels to insure upper and lower speed limits. The averaged power output is then applied as digital increments of pulse widths of approximately 1 microsecond in duration to provide a modulated speed control for the motors.

As can be appreciated, the longest time period for an individual axis will be utilized as the maximum time to derive an average velocity for each axis to ensure that each portion of the radial robot arm will start and stop at the same time. Once the robot arm has reached the desired location, the computer can activate various commands that have been previously stored to control the appropriate sequence of robot arm movements. For example, giving a pickup location and a dump location for a chess piece, a stored command can then implement these movements with the appropriate position coordinates. Other stored commands can likewise be called up such as a command that will control the movement of the robot arm to return to and activate the zero reference microswitches for each axis. Usually, the switch activation is desired to occur from the same direction (called the anti-backlash direction) to account for the hysterisis of the mechanical switch. Other commands, such as a SETUP routine to move all the pieces in an efficient fashion to conform to a desired setup, and the SKILL routine to have the robot arm point to a skill level desired and to sense the skill key for any changes in skill level, can also reside in stored commands.

Figure 7:
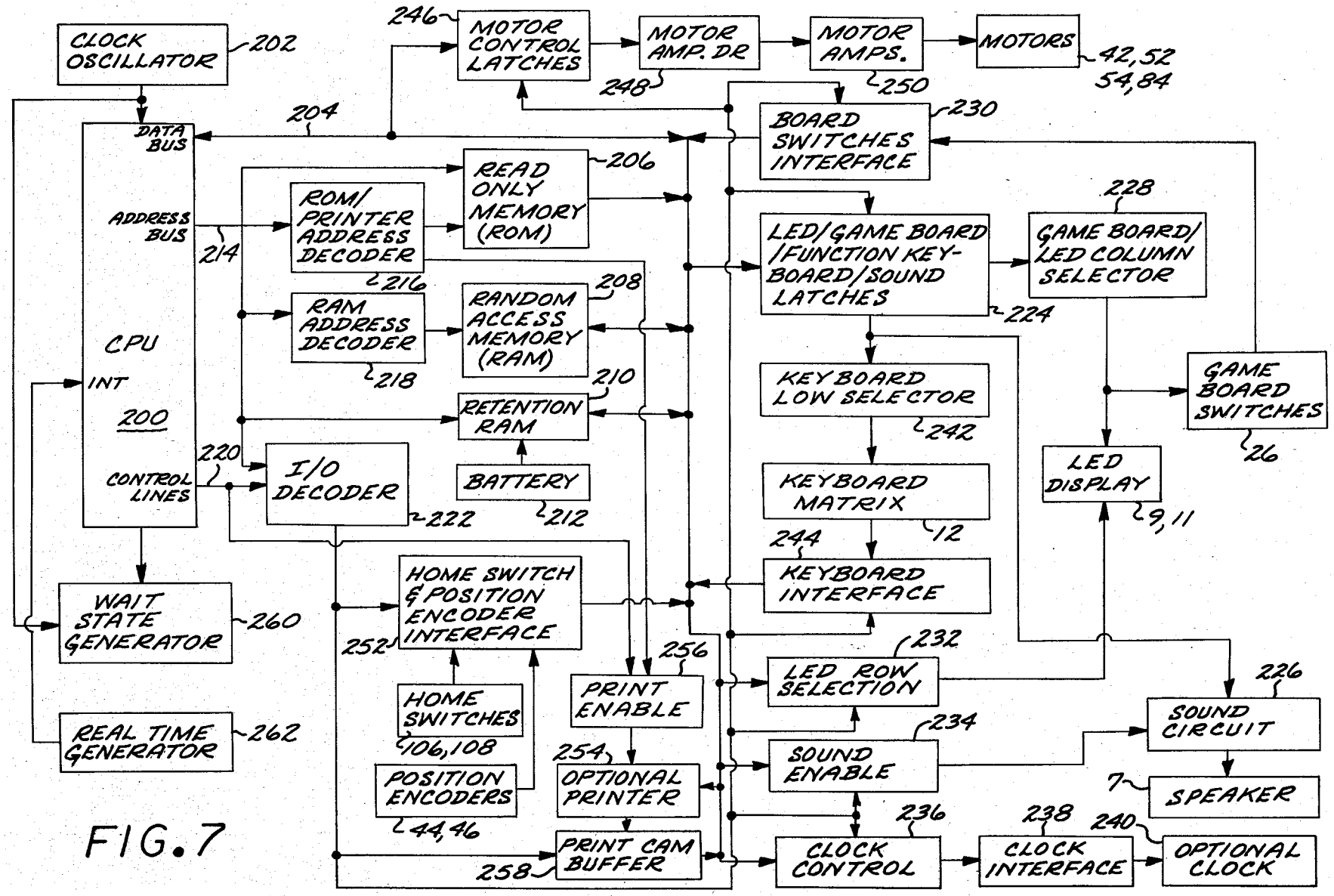
FIG. 7 is a block diagram disclosing the circuit of the present invention.

Referring now to the block diagram of FIG. 7, the circuitry for the disclosed chess game includes an integrated circuit Central Processing Unit (CPU) 200, as exemplified by a Zilog Z-80B, or other equivalent microprocessor. A crystal clock oscillator 2020 is provided to generate the necessary timing signal for the CPU 200. The CPU 200 includes a plurality of input-/output lines generally designated as a data bus 204 via which data is transferred to and from the CPU 200. External to the CPU 200 is a Read Only Memory (ROM) 206 which is used to store programs, constants, and other information utilized by the CPU 200. The ROM 206 is preferably comprised of a plurality of ROM integrated circuits, such as the Toshiba PMM2364P, or its equivalent.

The CPU 200 further utilizes a Random Access Memory (RAM) 208 and a retention RAM 210. These memories are utilized as working storage and for storing information pertinent to the features of the disclosed chess game such as the history of each move in a particular game. A separate retention RAM 210 is utilized for the SAVE feature of the disclosed chess game which allows the current board position of the uncompleted game to be retained, even though the system's power is turned off. A battery 212 is appropriately utilized to maintain information in the retention RAM 210.

The RAM 208 is preferably a plurality of integrated circuit Random Access Memory modules, such as the Toshiba TMM314AP. The retention RAM 210 is preferably of complimentary MOS technology with memory retention for a standby battery. An example is the RCA MWS5101 type LSI static random access memory. The battery 212 should conform with the requirements for retaining the memory of the particular retention RAM 210 that is actually used.

The CPU 200 addresses the locations in the external memories 206, 208 and 110 via a plurality of lines generally identified as an address bus 214. Some of the address bus lines are interconnected directly to the ROM 206 and the RAMs 208 and 210, while other address lines are applied to a ROM/printer address decoder 216 and a RAM address decoder 118. The ROM/printer address decoder is utilized also to enable an optional printer discussed further herein. These decoders will typically take as an input three address lines from the CPU 200 and will provide an output on one of eight output lines as a function of the value of the three bit combination inputed into the decoder. Such decoders are utilized so that a plurality of integrated circuit ROM and RAM modules may be utilized. An example of such a decoder is the Texas Instruments type SN74LS138 memory decoder.

The CPU 200 further includes a plurality of control lines, generally designated as 200, which are utilized for control purposes, such as enabling memory decoders and input/output decoders. The control functions associated with a microprocessor such as the Zilog Z80B are well understood by persons skilled in the art, and are further documented in publications available from the manufacturers of microprocessors.

The system of FIG. 7 further includes an input/output (I/O) decoder 222 that selectively enables input or output devices that are necessary to the operator of the disclosed chess game. The I/O decoder is controlled by the CPU 200 via selected control lines 220 and the address bus 214. Effectively, the I/O decoder 222 controls the input/output devices (described below) so that at a given short duration of time, only one input/output device is transferring data to or from the CPU 200. This allows for the advantageous use of interface circuitry that is common to several input/output devices. The I/O decoder 222 can, by way of example, be comprised of a commercially available decoder such as the Texas Instruments type SN74LS139 and 4-input NAND gates for initial decoding of some of the address and control lines.

For certain I/O functions controlled by the CPU 200, a plurality of memory latches 224 is provided for storing data from the CPU 200. As indicated on FIG. 7, the memory latches 224 are used to provide data for the LED displays 9 and 11 (FIG. 1), the game board switches 26 (FIG. 2), the keyboard 12 (FIG. 1), and a sound circuit 226. The sound circuit 226 is coupled to the speaker 7 shown in FIG. 1.

An LED/game board column detector array 228 is coupled to the output of the memory latches 224, and provides an output to the LED displays 9 and 11, and to the board switches 26. The column selector output is indicative of the column selected for display (LEDs) or for interrogation (game switches). The column selector 228 can be comprised of a plurality of Darlington-pair transistor circuits as provided in an integrated circuit array in the ULN-2804A available from Sprague Electronics.

The information in the memory latches 224 is not utilized simultaneously by the associated input/output devices, but rather sequentially as determined by the I/O decoder 222. Therefore, other devices are included to control the input/output devices.

Associated with the game switch 26 is a game switch buffer 230 which is selectively enabled by the I/O decoder 222. When enabled, the game switch buffer 230 provides an output to the data bus 204 indicative of which switch in a selected column of the game switch array 26 was actuated. By way of example, the game switch buffer 230 can be comprised of a plurality of voltage comparators such as those in the National Semiconductor LM339. The I/O decoder 222 is utilized to provide the enabling and disabling voltage references for the voltage comparators.

A row selector circuit 232 is utilized selecting the appropriate elements of the selected column of the LED displays 9 and 11 in response to the I/O decoder 222 and the CPU 200. The row control circuit, as is well known in the art, can generally comprise a plurality of D-type flip-flops for accepting data from the data bus 204 under control of the I/O decoder 222. The flip-flop outputs are then gated to transistors which appropriately turn on the selected LEDs of the displays 9 and 11. An example of integrated circuit D-type flip-flops is the Texas Instruments type SN174LS175. A sound enable circuit 234 is provided for enabling the sound circuit 226 under control of the I/O decoder 222 and the CPU 100. The sound enable circuit 234 is preferably a D-type flip-flop which has its positive output coupled to the sound circuit 226.

The sound circuit 226 is preferably an integrated circuit sound synthesizer such as the Texas Instruments type SN76489 with appropriate output amplification. The input data for the sound circuit is provided by the memory latches 224. Thus, the sound circuit 226 will be enabled only when appropriate sound data is available.

Also operating under the control of the I/O decoder 222 is a clock control circuit 236 which can be a plurality of D-type flip-flops responsive to the I/O decoder 222 and the data bus 204. The positive outputs of the flip-flops can then be utilized to control a clock interface 238, which in turn controls an optional clock 240.

The optional clock 240 is contemplated as being a pair of countdown clock circuits wherein one clock circuit is associated with the chess computer and the other clock circuit is associated with the human player. Since the amount of elapsed time measured is a function of how long it takes to make a move, the clock circuits in the optional clock 240 are automatically stopped when an appropriate move is made. Thus, the outputs of the flip-flops of the clock control 236 could then be used to control integrated circuit bilateral switches such as those on National Semiconductor's CD4066 quad bilateral switch. The opening or closing of the switches would allow or prevent the counting of either of both of the clock circuits associated with the optional clock 144.

The memory latches 224 further provide information for interrogating the keyboard matrix 12 via a keyboard row selector 242. The keyboard row selector 242 can comprise a pluraity of inverting amplifiers. Associated with the keyboard matrix 12 is a keyboard interface 244 which is controlled by the I/O decoder 222. As with the board switches interface 230, the keyboard interface 244 can be a plurality of voltage comparators available in integrated circuit packages.

Figure 4:
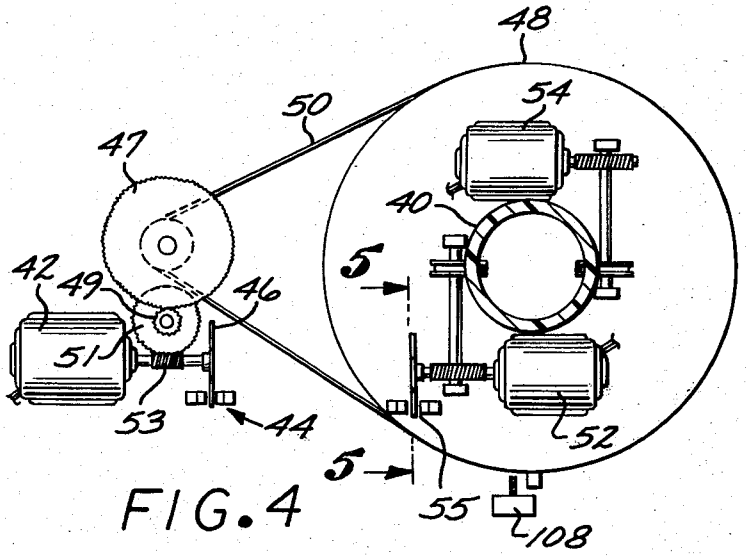
FIG. 4 is a plan view of a portion of the drive motors of the game board.

The motors 42, 52, 54 and 84 (see FIGS. 3 and 4 also) are controlled by data provided on the data bus 204 to motor control latches 246 which are controlled by the I/O decoder 222. By way of example, the motor control latches 246 can comprise a plurality of D-type flip-flop such as those in the Texas Instruments type SN74LS175 integrated circuit. The outputs of the motor control latches are coupled to motor amplifier drivers 248, which can preferably be Darlington-pair circuits. As mentioned before, such Darlington-pair circuits are available in integrated circuit packages such as the Spargue Electronics type ULN-2804. The outputs of the motor amplifier drivers 248 are applied to conventional transistor motor amplifiers 250.

As discussed previously, two of the motors (namely the motors 42 and 52) have position encoders associated with them. Each encoder included an optical sensor 44 and an occulator 46. Also instrumental in ascertaining the position of the arms associated with the motors 42 and 52 are home switches 106 and 108. Optical encoder information and home switch information is selectively provided to the CPU 200 via a home switch and position encoder interface 252. The interface 252 is controlled by the I/O decoder 222.

A further output device is an optional printer 254 such as readily available dot matrix printers. The printer is enabled by print enable circuit 256 which is controlled by the ROM/printer address decoder 216 and appropriate output control signals on the control lines 220 from the CPU 200. The print enable circuit 256 can be readily made from a pair of NOR gates, wherein one output turns on the print motor and the other output provides a print signal. The data to the optional printer is transferred via the data bus 204.

In order for the CPU 200 to know the position of the printer cam, a print cam buffer 258 is provided. The buffer provides information to the data bus under the control of the I/O decoder 222. Voltage comparators, such as the National Semiconductor type LM339, can be used as the print cam buffer 258, and the reference voltages can be appropriately provided by the I/O decoder 222.

Preferably, the CPU 200 operates at a high frequency, such as 6 MHZ, in order to maximize its computational capabilities. However, the memories 200, 208 and 210 will generally be slower. Therefore, a Wait State Generator 260 is provided which is responsive to the CPU 200. When data is being transferred to or from the CPU 200 to some external memory, the Wait State Generator 260 provides a Wait input to the CPU 200 for a predetermined amount of time. The presence of the Wait signal stops the processing of the CPU 200 so that the external memories can provide or accept data. In the exemplary Zilog Z80B microprocessor, pin 24 is the WAIT input. The Wait State Generator 260 can be built from a pair of interconnected flip-flops whose outputs are coupled to an OR gate. The flip-flops can be in an integrated circuit, such as the National Semiconductor DM74LS74 dual D-type flip-flogs, and can be toggled by the output of the clock oscillator 202.

For real-time control purposes, a real time interrupt generator 262 is coupled to the CPU 200. Preferably, the interrupt generator 262 provides interrupt signals at a frequency of 1 KHz. Thus, the interrupt generator can be a pulse generator that provides pulses of the appropriate logic level at a frequency of 1 KHz. In the Zilog Z80B, a previously mentioned example for the CPU 200, pin 16 is the $\overline{\text{INT}}$ (interrupt) input. The real time interrupt generator thus provides the CPU 200 with a real time reference which is necessary for the control of the arm motors 42 and 52, and for determining velocity information from the position encoders 44 and 46. The real time reference can also be utilized for controlling the sound circuit 226 and the LED displays 9 and 11.

In operation, the human player can activate the robot computer chess game assembly 2 from a power switch (not shown). Generally, the human player will manually set up the chess pieces on the chess board 6 from the respective storage areas 8 and 10. The computer will assume that upon the appropriate activation of the switches under the chess board 6 that the proper chess pieces have been appropriately positioned. If desired, the VERIFY button can be used to verify that the computer knows the location of all the chess pieces on the chess board. The computer will automatically assume that the human player has chosen the white pieces and will await the human's first move. After the first move, the computer will respond and it is then possible for the human player to play a complete game of chess in a normal manner as if he was playing against another human opponent. The robot arm 14 will make all the moves that a skilled human opponent would do, including the capturing and removing of chess pieces from the board. It should be noted that the computer will assume that the human, when he captures and removes a piece from the board, will appropriately position the pieces from the back to the front of the storage areas.

Figure 13:
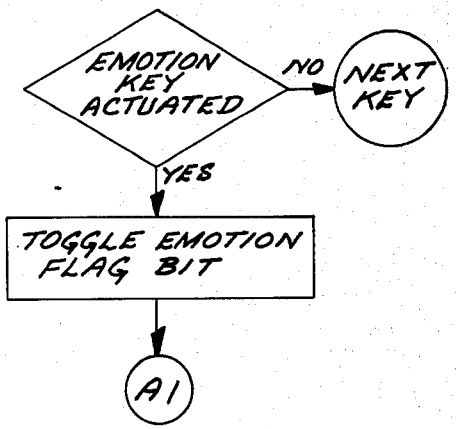
Figure 15:
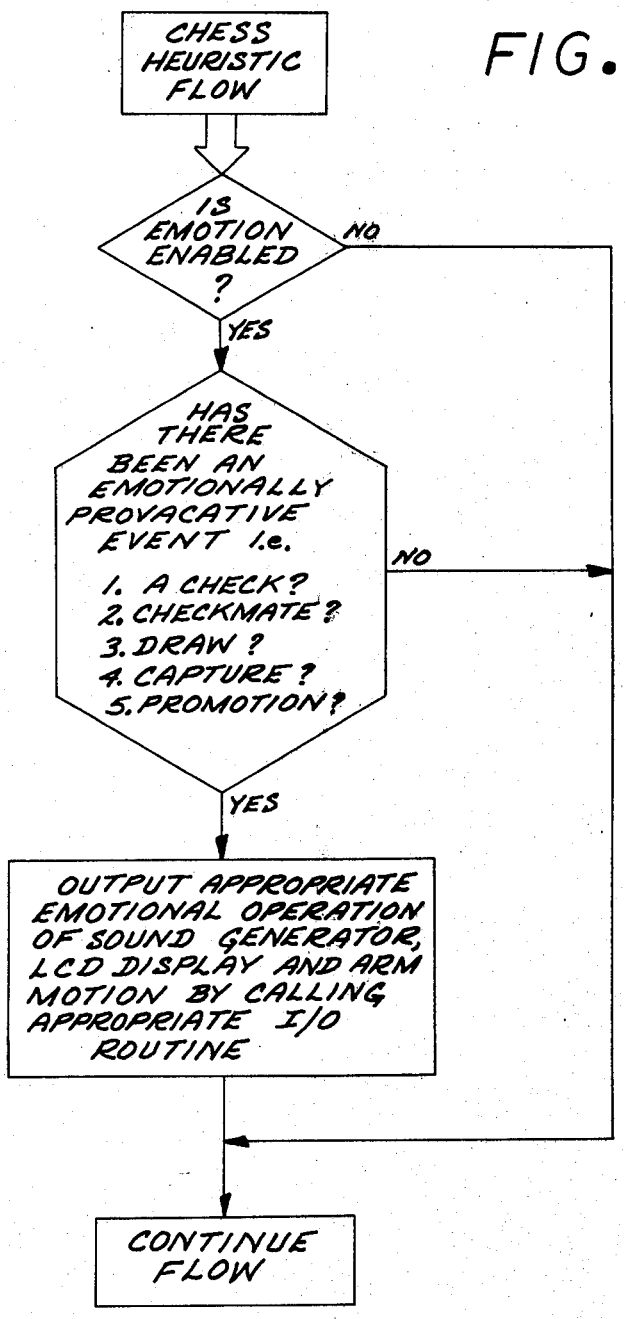

If the human player had actuated the EMOTION key on the keyboard 12, see FIGS. 13 and 15, then upon the occurrence of a significant event, e.g., capturing of a queen, promotion of a pawn, imminent checkmate, etc., the robot arm 14, the lights 9 and 11, and the speaker 7 can provide complementary physical, visual and vocal events to indicate appropriate emotion on the part of the computer opponent. Commands can be appropriately stored to effectuate these routines, and can be called from storage by the occurrence of the event as determined from the values developed in the chess heuristic. For example, if the human player captures the computer's queen, a sigh can emit from the speaker 7, the lights 9 can go dim, and the robot arm 14 can pivot the outer arm portion 20 in a slow oscillating curvilinear movement. Conversely, if the human player loses his queen, then an uplifting music beat can be generated through the speaker 7, the lights 9 and the panel lights 11 can brightly blinked and the arm portion 20 can rapidly rotate with a corresponding opening and closing of the grasping fingers 16. As can be readily appreciated, various modifications are possible to display emotions since the humanoid characteristics of arm movement, sounds, and visual occurrrences can be utilized.

A preferred embodiment of the present invention is disclosed herein in such a manner to permit any person skilled in this field to understand and duplicate the invention; however, it should be appreciated that numerous modifications are possible, once given the teachings of the present invention.

Accordingly, the present invention should be measured solely from the following claims, wherein we claim:

1. In a computer controlled chess game having a housing member, a chess board, chess pieces, a computer processing circuit, a memory unit, a robot arm movably mounted adjacent the chess board, and means on the robot arm for grasping and releasing a chess piece, the improvement comprising:

a multiple layer switch member positioned beneath each chess square to indicate the presence or absence of a chess piece;

a magnetic member for each chess piece;

a plurality of cavities beneath said multiple layer switch member and the chess board corresponding to each chess square and having a magnetic member movably contained therein, the cross-sectional area of said cavity configured to at least conform to the cross-sectional area of said magnetic member of the chess piece wherein placement of said chess piece actuates said switch member and spatially positions said chess piece at a predetermined location on each chess square to ensure alignment for coaction with the grasping and releasing means.

2. The invention of claim 1 further including a chess piece storage member having a designed storage position for each type of chess piece, positioned adjacent the chess board and within the operative movement of the robot arm and additional storage switch members positioned beneath each storage position to indicate the presence of a chess piece, the magnetic means further capable of actuating the storage switch members and spatially positioning the stored pieces at predetermined locations.

3. The invention of claim 1 further including means for producing intelligent audible sounds.

4. The invention of claim 1 wherein the switch member is a resilient flat assembly of at least two layers of flexible conductive sheets spaced from each other by insulating spacer members.

5. The invention of claim 1 wherein the robot arm is articulated into at least two portions and further including means for coordinating the relative movement of each articulated portion of the robot arm to ensure that the relative movement starts and stops at approximately the same time.

6. The invention of claim 1 wherein the means on the robot arm for grasping and releasing includes a plurality of spring biased arms and a cam means for opening the arms against the spring pressure.

7. In a computer controlled chess game having a housing member, a chess board, chess pieces, a computer processing circuit, a memory unit, a robot arm movably mounted adjacent the chess board, means on the robot arm for grasping and releasing a chess piece, driving means for operatively moving the robot arm across the chess board, means for determining the current position of the robot arm, means for determining the desired final position of the robot arm in accordance with the desired implementation of the chess game, means for plotting the shortest path of movement of the robot arm from its current position to the desired final position for execution by the driving means, the improvement comprising:

means for determining the existence of a predetermined event of particular significance in the playing of a chess game and producing a corresponding event signal, and means for altering the execution by the driving means of the plotted shortest path of movement between the current robot arm position and final position, in response to the event signal, to impose a relatively deviant movement to indicate a manifestation of physical movement by the robot arm corresponding to an emotional response to the predetermined event.

8. The invention of claim 7 further including a sound generator for producing predetermined sounds and light means for producing predetermined displays of light wherein the means for altering that responds to the event signal further activates sounds and lights complementary to the emotional response.

9. The invention of claim 8 wherein the deviant movement includes repetitive opening and closing of the grasping and releasing means.

10. The invention of claim 7 wherein the deviant movement is curvilinear.

11. In a computer controlled chess game having a housing member, a chess board, chess pieces, a computer processing circuit, a memory unit, a robot arm movably mounted adjacent the chess board, means for grasping and releasing a chess piece, and means for determining the current position of the robot arm, the improvement comprising:

means for providing an indication of a suggested move from the computer processing circuit as a response for a human player;

means for driving the robot arm from its current position to a start position over the chess piece that is suggested to be moved;

means for lowering and raising the robot arm towards and from the designated chess piece without moving the same;

means to subsequently drive the robot arm to the designated end suggested rest position of the designated chess piece, and means for lowering and raising the robot arm towards and from the designated rest position without disturbing the current chess piece, if any, occupying the designated end rest position.

12. The invention of claim 11 further including means for determining the desired final position of the robot arm in accordance with the desired implementation of the chess game; means for plotting the shortest path of movement of the robot arm from its current position to the desired final position for execution by the driving means; means for determining the existence of a predetermined event of particular significance in the playing of a chess game and producing a corresponding event signal, and means for altering the execution by the driving means of the plotted shortest path of movement between the current position and final position to impose a relatively deviant movement to indicate a manifestation of physical movement by the robot arm corresponding to an emotional response to the predetermined event in response to the event signal.

13. In a computer controlled chess game having a housing member, a chess board, chess pieces, a computer processing circuit, a memory unit, a robot arm movably mounted adjacent the chess board, means for grasping and releasing a chess piece, and means for determining the current position of the robot arm, a keyboard for inputing signals to the computer processing circuit including the desired level of skill to be implemented in searching the memory unit during a chess game, the improvement comprising:

an indexed portion of the housing member surface divided into discrete segments representative of incremental skill levels;

means for driving the robot arm from its current position to a start position above the indexed discrete segments;

means for driving the robot arm to scan sequentially each discrete segment;

means for lowering and raising the robot arm towards and from a discrete segment; and means for activating the desired skill level indicated by the robot arm.

14. In a computer controlled game having a housing member, an indexed game board, game pieces, a computer processing circuit, a memory unit, a robot arm movably mounted adjacent the game board, means for grasping and releasing a game piece, the improvement comprising:

a multiple layer switch member positioned beneath each indexed position to indicate the presence or absence of a game piece;

a magnetic member for each game piece;

a plurality of cavities beneath said multiple layer switch member and the game board corresponding to each indexed position and having a magnetic member movably contained therein, the cross-sectional area of said cavity configured to at least conform to the cross-sectioned area of said magnetic member of the game piece wherein placement of said game piece actuates said switch member and spatially positions said game piece at a predetermined location on each indexed position to ensure alignment for coaction with the grasping and releasing means.

15. In a computer controlled chess game having a housing member, a chess board, chess pieces, a computer processing circuit, a memory unit, a robot arm movably mounted adjacent the chess board, and means on the robot arm for grasping and releasing a chess piece, the improvement comprising:

a switch member positioned beneath each chess square to indicate the presence of a chess piece;

magnetic means for actuating the switch member and for further spatially positioning a chess piece at a predetermined location on each chess square to ensure alignment for coaction with the grasping and releasing means, the robot arm being articulated into at least two portions;

means for coordinating the relative movement of each articulated portion of the robot arm to ensure that the relative movement starts and stops at approximately the same time;

a first motor to rotate the entire articulated robot arm;

first monitor means to determine the amount of movement of the entire robot arm;

a second motor to rotate the articulated portion attached to the means for grasping and releasing;

second monitor means to determine the amount of movement of the articulated portion, and control means connected to the first and second motor and the first and second monitor means for driving the entire robot arm and the relatively movable articulated portion at respective rates of velocity to ensure both movements are halted at the same time above predetermined chess piece locations.

16. The invention of claim 15 wherein the articulated portion comprises a parallelepiped configuration and a third motor connected to the articulated portion to drive it in a downward direction.

17. The invention of claim 16 wherein the articulated portion is spring biased to a closed position of the articulated portions positioned against each other.

18. The invention of claim 7 further including a position switch on the articulated portions to provide a position signal to the control means.

19. In a computer controlled chess game having a housing member, a chess board, chess pieces, a computer processing circuit, a memory unit, a robot arm movably mounted adjacent the chess board, and means on the robot arm for grasping and releasing a chess piece, the improvement comprising:

a switch member positioned beneath each chess square to indicate the presence of a chess piece;

magnetic means for actuating the switch member and for further spatially positioning a chess piece at a predetermined location on each chess square to ensure alignment for coaction with the grasping and releasing means;

driving means for operatively moving the robot arm across the chess board;

means for determining the current position of the robot arm;

means for determining the desired final position of the robot arm in accordance with the desired implementation of the chess game;

means for plotting the shortest path of movement of the robot arm from its current position to the desired final position for execution by the driving means;

means for determining the existence of a predetermined event of particular significance in the playing of a chess game and producing a corresponding event signal, and means for altering the execution by the driving means of the plotted shortest path of movement between the current position and final position to impose a relatively deviant movement to indicate a manifestation of physical movement by the robot arm corresponding to an emotional response to the predetermined event in response to the event signal.

20. In a computer controlled chess game having a housing member, a chess board, chess pieces, a computer processing circuit, a memory unit, a robot arm movably mounted adjacent the chess board, and means on the robot arm for grasping and releasing a chess piece, the improvement comprising:

a switch member positioned beneath each chess square to indicate the presence of a chess piece;

magnetic means for actuating the switch member and for further spatially positioning a chess piece at a predetermined location on each chess square to ensure alignment for coaction with the grasping and releasing means;

means for providing an indication of a suggested move from the computer processing circuit as a response for a human player;

means for driving the robot arm from its current position to a start position over the chess piece that is suggested to be moved;

means for lowering and raising the robot arm towards and from the designated chess piece without moving the same;

means to subsequently drive the robot arm to the designated end suggested rest position of the designated chess piece, and means for lowering and raising the robot arm towards and from the designated rest position without disturbing the current chess piece, if any, occupying the designated end rest position.

21. In a computer controlled chess game having a housing member, a chess board, chess pieces, a computer processing circuit, a memory unit, a robot arm movably mounted adjacent the chess board, and means on the robot arm for grasping and releasing a chess piece, the improvement comprising:

a switch member positioned beneath each chess square to indicate the presence of a chess piece;

magnetic means for actuating the switch member and for further spatially positioning a chess piece at a predetermined location on each chess square to ensure alignment for coaction with the grasping and releasing means;

means for determining the current position of the robot arm;

a keyboard for inputting signals to the computer processing circuit including the desired level of skill to be implemented in searching the memory unit during a chess game;

an indexed portion of the housing member surface divided into discrete segments representative of incremental skill levels;

means for driving the robot arm from its current position to a start position above the indexed discrete segments;

means for driving the robot arm to scan sequentially each discrete segment;

means for lowering and raising the robot arm towards and from a discrete segment, and means for activating the desired skill level indicated by the robot arm.

* * * * *

UNITED STATES PATENT AND TRADEMARK OFFICE

CERTIFICATE OF CORRECTION

PATENT NO. : 4,398,720

DATED : August 16, 1983

INVENTOR(S) : Lawrence T. Jones et al.

It is certified that error appears in the above-identified patent and that said Letters Patent is hereby corrected as shown below:

Column 8, line 12, "themove" should be --the move--.
line 56, "FIg." should be --Fig.--.
Column 9, line 31, after the word "members." the word "The" should begin a paragraph.
Column 14, line 8, "pluraity" should be --plurality--.
Column 16, line 30, "designed" should be --designated--.

Signed and Sealed this

Nineteenth Day of February 1985

[SEAL]

*Attest:*

DONALD J. QUIGG

*Attesting Officer*

*Acting Commissioner of Patents and Trademarks*